US005624028A

United States Patent [19]

Shin et al.

[11] Patent Number: 5,624,028

[45] Date of Patent: Apr. 29, 1997

[54] FOAM ORGANIZER

[75] Inventors: Han S. Shin, Seoul, Rep. of Korea; Byung Shin, 2500 White Rd., Irvine, Calif. 92714

[73] Assignee: Byung Shin, Irvine, Calif.

[21] Appl. No.: 526,816

[22] Filed: Sep. 11, 1995

Related U.S. Application Data

[63] Continuation-in-part of Ser. No. 412,702, Mar. 29, 1995, which is a continuation-in-part of Ser. No. 103,667, Aug. 8, 1993, Pat. No. 5,450,958, which is a continuation of Ser. No. 924,563, Aug. 3, 1992, Pat. No. 5,311,987.

[51] Int. Cl.[6] ..... A63B 55/00

[52] U.S. Cl. ..... 206/315.6; 206/315.3; 206/315.5

[58] Field of Search ..... 206/315.3, 315.5, 206/315.6

[56] References Cited

U.S. PATENT DOCUMENTS

| | | | |
|---|---|---|---|
| 936,698 | 10/1909 | Breakspear | 206/315.6 |
| 1,840,183 | 1/1932 | Blitch | 206/315.6 |
| 2,879,819 | 3/1959 | Turnbull | 206/315.4 |
| 3,331,419 | 7/1967 | Bencriscutto | 206/315.6 |
| 3,554,255 | 1/1971 | Mangan | 206/315.6 |
| 3,941,398 | 3/1976 | Nelson | 206/315.6 X |
| 4,241,774 | 12/1980 | Pell | 206/315.6 |
| 4,332,283 | 6/1982 | Rader | 206/315.6 |
| 4,383,563 | 5/1983 | Kerchhoff, Jr. | 206/315.5 X |
| 4,944,396 | 7/1990 | Larkin | 206/315.6 |
| 5,135,107 | 8/1992 | Ingraham | 206/315.2 X |
| 5,226,533 | 7/1993 | Antonious | 206/315.6 |
| 5,228,566 | 7/1993 | Shenoba | 206/315.6 |
| 5,431,278 | 7/1995 | Gretz | 206/315.6 |
| 5,458,240 | 10/1995 | Rich et al. | 206/315.6 X |

FOREIGN PATENT DOCUMENTS

| | | | |
|---|---|---|---|
| 2130102 | 5/1984 | United Kingdom | 206/315.6 |

*Primary Examiner*—Sue A. Weaver
*Attorney, Agent, or Firm*—John J. Connors; Connors & Assoc.

[57] ABSTRACT

A golf bag holds golf clubs in a cavity in which a golf club receptacle structure is disposed. This receptacle structure has several versions. In one, an external, truncated, conical end portion at least partially extends outward from the cavity, with a plurality of openings which extend in a lengthwise direction through the receptacle structure, each opening sized to receive only one golf club. In another, the receptacle structure has a central portion and a marginal portion at a lower level than the central portion which surrounds, at least partially, said central portion. A third version of the receptacle structure has a top which has a first section a one level, a second section at an elevated level above said first section, and an intermediate section connecting said first and second sections. There are several unique features of the golf bag. One is a foam insulation insert within a side pocket that has at least one cylindrically shaped cavity sized to receive a beverage can to allow the can to fit snugly, yet removably, within the cavity. A second feature is golf ball holder made of a flexible, tubular material having a diameter about equal to the diameter of a golf ball. The opposed ends of the holder are closed to retain golf balls within the holder. One end has hook members of a hook and fabric type fastener that opens upon manually squeezing the holder to open the fastener and force a golf ball through this one end.

14 Claims, 12 Drawing Sheets

FIG. 9A
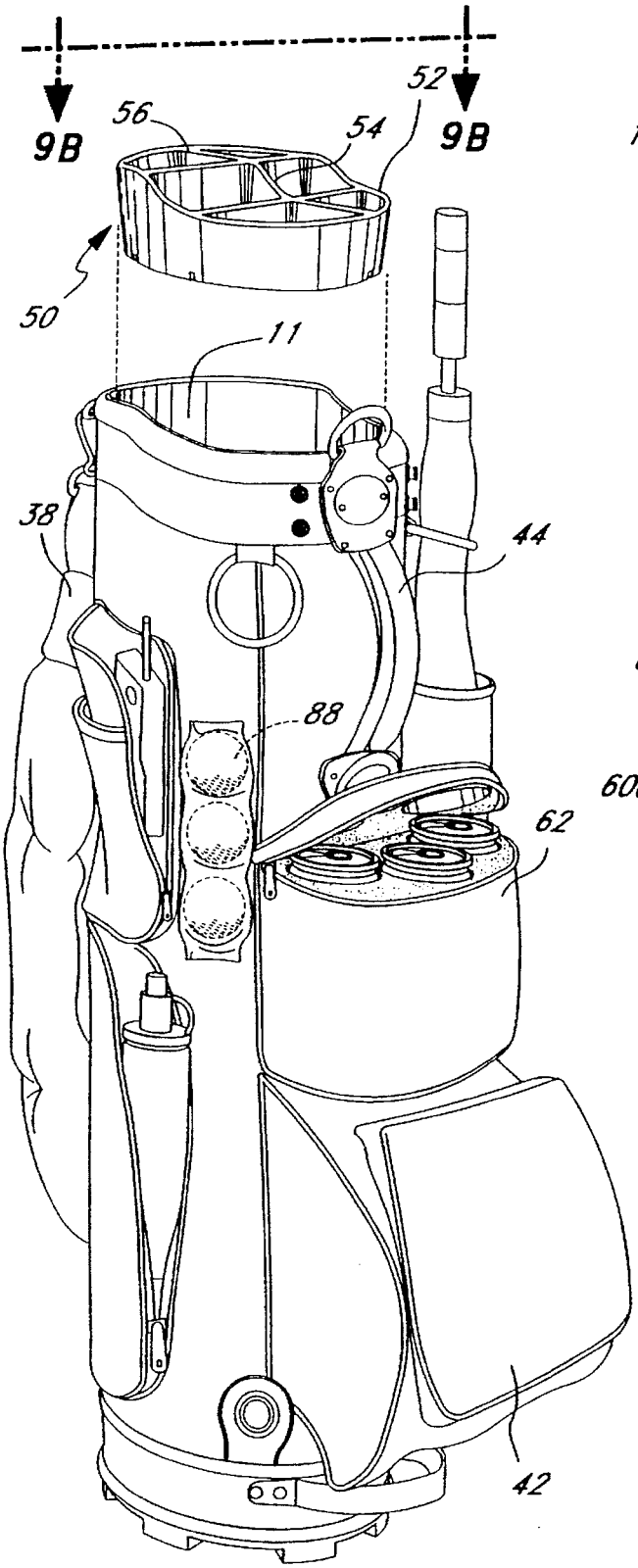
FIG. 8
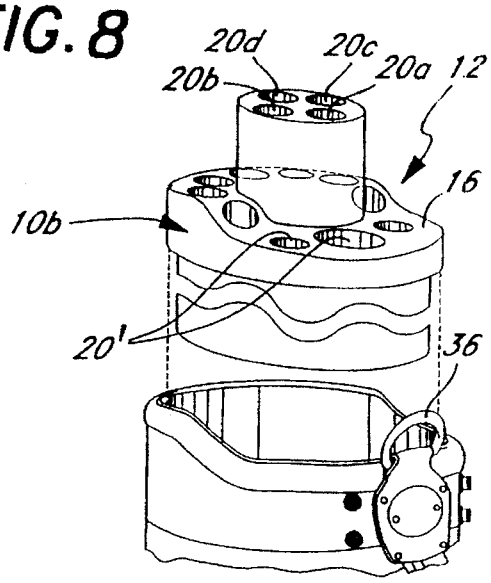
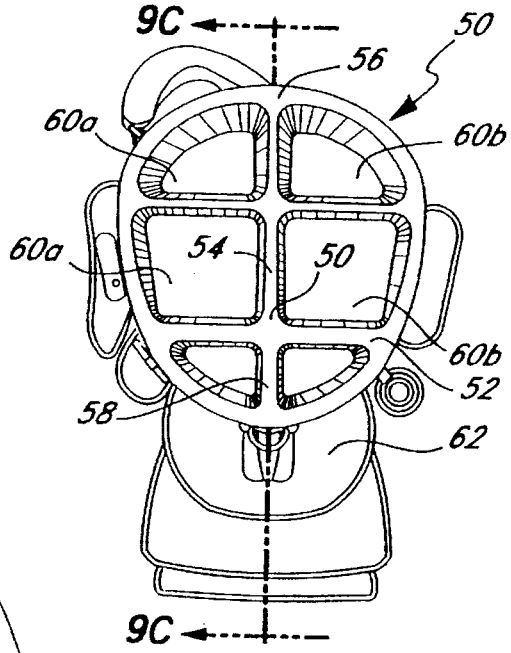
FIG. 9B
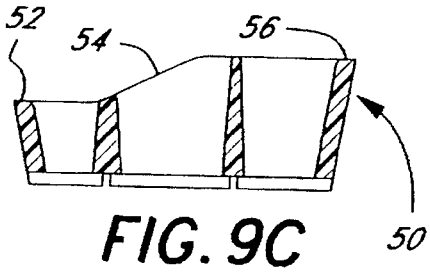
FIG. 9C 92a
90
88

92
90
88
92

10B
10C
10C
10B
66

63

10A
10A
63
62
66
64
80
78
88
66
66

FIG. 15
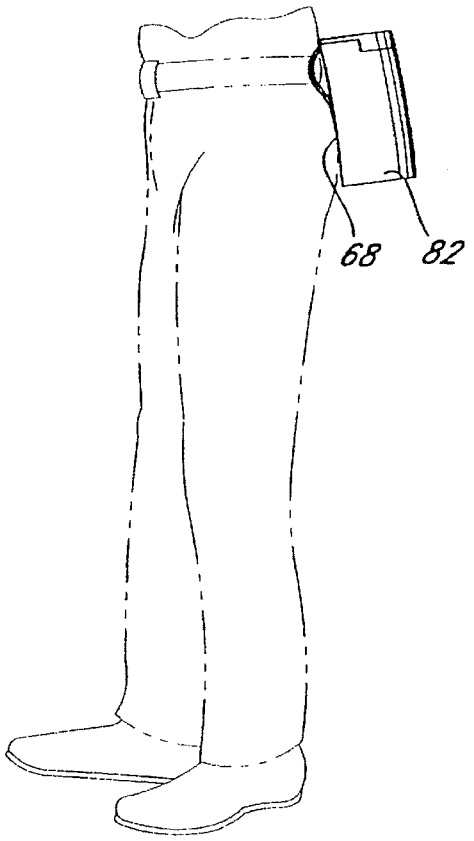
FIG. 16
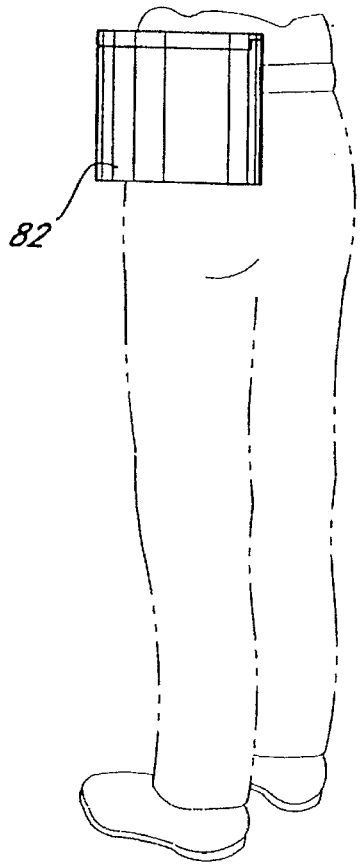
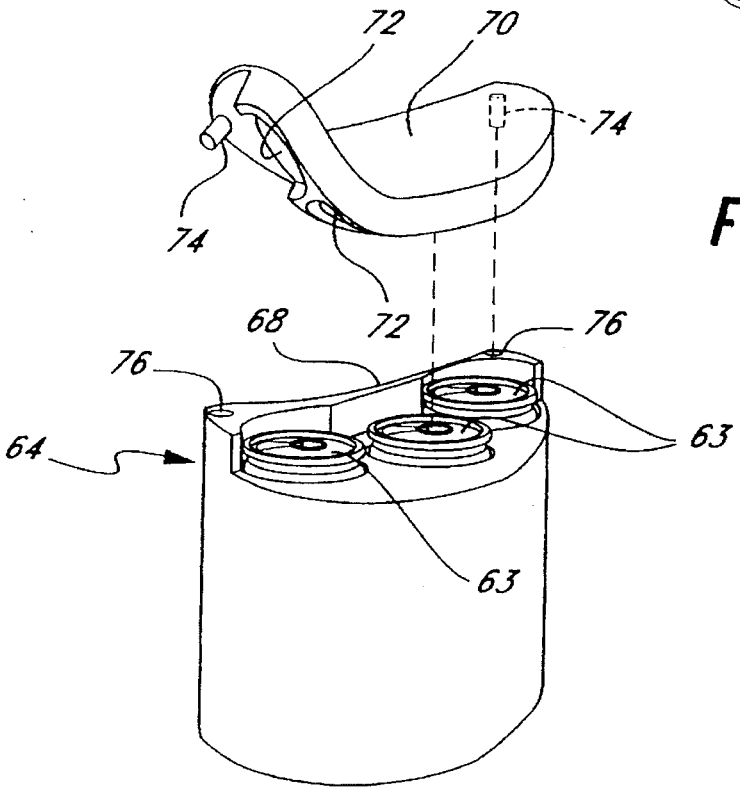
FIG. 10D

FOAM ORGANIZER

RELATED PATENT APPLICATIONS

This application is a continuation-in-part application of U.S. Ser. No. 08/412,702, entitled "Foam Organizer," filed Mar. 29, 1995, which is a continuation-in-part of U.S. Ser. No. 08/103,667, entitled "Golf Bag With Foam Organizer," filed Aug. 8, 1993, now U.S. Pat. No. 5,450,958, which is a continuation application of U.S. Ser. No. 07/924,63, entitled "Golf Bag With Foam Organizer," filed Aug. 3, 1992, now U.S. Pat. No. 5,311,987. All of these related applications are incorporated herein by reference and made a part of this application.

BACKGROUND OF THE INVENTION

1. Field Of the Invention:

The present invention relates to a golf bag, and more particularly to a golf bag providing an improved golf club receptacle structure for storing a plurality of golf clubs therein.

2. Background Discussion:

A conventional golf bag, as shown in FIG. 1, provides a predetermined number of partition walls 30 arranged at the upper portion of a body 10 in a crisscrossing configuration to form a plurality of receptacles 20, each of which receives a few golf clubs, as one desires. But this golf club receptacle structure has difficulties in managing the golf bag. In general, the golf bag has ten golf clubs, or more, which are properly classified in each of receptacles 20, for example, thirteen clubs in a woman's case and fourteen clubs in a man's case. During carrying of the golf bag, the clapping between the grouped golf clubs stored therein causes noise and also damages them at the lower portion rather than at the upper portion. Furthermore, when the golf bag is mistakenly dropped and turned over, the golf club grip is cracked or otherwise damaged.

SUMMARY OF THE INVENTION

The golf bag of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its advantages, which include low cost manufacture, protection of golf clubs, noise reduction or elimination, light weight, simplicity of use, particularly with a golf cart, convenience in dispensing golf balls, and convenience in storage and portability of beverage containers while playing golf. To accomplish these objects and features, the present invention has several embodiments.

The first embodiment of the golf bag of this invention provides a receptacle member made of foam and having a plurality of holes, or channels, extending lengthwise. Each hole, or channel, receives only one golf club. The receptacle member is preferably sized to range from equal in height of the golf bag to ⅓ of the height of the golf bag. Hard sponge materials having a waterproof property in the form of closed cells is preferred, such as, for example, polyurethane foam. This receptacle member may be extruded from a mold. The receptacle holes or channels are perforated in the structure based on the number of golf clubs to be stored, and only one golf club is stored in a single hole or channel. Therefore, the receptacle member absorbs the impacts caused due to the shaking of the stored golf clubs during the carrying. Especially, the receptacle member is manufacturable in the form of a removable, foam insert to be used in any shape of golf bag. That is, the cross-sectional configuration of the receptacle structure conforms to the cross-sectional configuration of the cavity of the golf bag so that this receptacle structure fits snug in the cavity, but can be removed. The receptacle structure is near the open top of the cavity of the golf bag, and extends into the cavity from an open top of the cavity. One of the important features of the receptacle is that it is light weight, having a density of 12 pounds per cubic feet or less, preferably from 10 to 12 pounds per cubic feet. This embodiment of the present invention has as its main objective the provision of a foam organizer bag with an improved golf club receptacle structure for removing the cause of the noise by the dashes between grouped golf clubs stored therein as well as for assuring the reliable protection and maintenance of the golf clubs, particularly golf clubs with graphite shafts. The clubs are separated from one another to prevent them from clashing against each other. This suppresses noise and, more importantly, protects the golf clubs, particularly graphite shaft clubs.

The second embodiment of the golf bag of this invention is designed to hold golf clubs so that the heads of the clubs, particularly the irons, do not clash. It includes a cavity in which a golf club receptacle structure is disposed. This receptacle structure has a central section including a plurality of openings which extend in a lengthwise direction through the receptacle structure. Each opening is sized to receive only one golf club. There is a marginal section at a lower level than the central section which surrounds, at least partially, the central section. The marginal section includes a plurality of openings which extend in a lengthwise direction through the receptacle structure, each opening sized to receive only one golf club. The central section is elevated above the marginal section a sufficient distance so that the clubs received in the opening in the marginal section do not strike clubs in the opening in the central section.

This embodiment has two versions: In the first version, the central section has a substantially cylindrical configuration, and this central section and the marginal section each have substantially flat, planar tops in which the opening terminate. In the second version, the receptacle structure has (a) an internal end portion which is received within the cavity, (b) an external, truncated, conical end portion at least partially extending outward from the cavity, and (c) a plurality of openings which extend in a lengthwise direction through said receptacle structure.

In one example of the second version, each opening is sized to receive only one golf club. The end portion has a substantially flat, central, planar top and a sloping side wall. There are a first predetermined number of the openings intersecting the side wall and a second predetermined number of the openings intersecting only the top. At least some of the first predetermined number of the openings intersect both the side wall and the top, along the edge where the top and side wall meet. A golf club upon being placed in one of the first predetermined number of the openings has its shaft passing through the one opening and its head bearing against the sloping side wall of the receptacle structure. The sloping side wall limits the distance the head can turn while in the one opening, so that the head is prevented from striking the head of another golf in an adjacent opening in the sloping side wall.

In both versions of the second embodiment the receptacle structure is removable and made from a foam material which is preferably water proof, having closed cells. The foam material has a density of 12 pounds per cubic feet or less. Preferably, the foam material has an exterior which is covered, at least partially, by thin, protective skin.

The third embodiment of the golf bag of this invention includes a bag body with a cavity for holding golf clubs, with a relatively shallow receptacle structure in an open mouth of the cavity. The receptacle structure occupies less than ⅓ the length of the cavity, and it includes a plurality of openings that receive at least one golf club and can hold more. The receptacle structure has a configuration substantially corresponding in shape to the configuration of the open mouth, so that the receptacle structure fits snug within the open mouth, and it is made from a foam material which is water proof, having closed cells, and has a density of 12 pounds per cubic feet or less. The foam material has an exterior which is covered, at least partially, by thin, protective skin. The receptacle structure has a top which has a first section a one level, a second section at an elevated level above said first section, and an intermediate section connecting the first and second sections. Each section includes a partition wall that divides each section into approximately two equally sized openings which receive one or more golf clubs. The partition walls of each section are aligned. This provides six enlarged opening that hold a group of clubs. Preferably, there are internal walls in each enlarged opening which slope inward.

The fourth embodiment of the golf bag of this invention includes a bag body for holding golf clubs, with the bag body having a side portion including a pocket. There is a foam insert within the pocket which provides insulation. This foam insert has at least one (preferably three) cylindrically shaped cavity sized to receive a beverage can to allow the can to fit snugly, yet removably, within the cavity. A cover fits over the insert and a can disposed within said cavity. This cover has attached to it another foam insert that is substantially thinner that the insert in the pocket. There are aligned indentations having circular diameters that are about equal to the diameter of the beverage cans. These indentations are aligned with the openings upon closing the cover, with the tops of the cans being received in these indentations. The foam insert preferably is removable, and has a side wall that is arcuate. Upon removal, the foam insert is adapted to be placed in a carrying pouch that is worn by a user. Like the receptacle structure for the golf clubs, the foam insert is preferably water proof, has closed cells, and a density of 12 pounds per cubic feet or less. Preferably, the foam insert has an exterior which is covered, at least partially, by thin, protective skin.

The fifth embodiment of the golf bag of this invention includes a bag body for holding golf clubs, with the bag body having a side portion including a golf ball holder for holding one or more golf balls. The holder is made of a flexible material formed into a tubular configuration having a diameter about equal to the diameter of a golf ball, with the holder having opposed ends that are closed to retain golf bails within the holder. One of the ends includes hook members of a hook and fabric type fastener that opens upon manually squeezing the holder to open the fastener and force a golf ball through the one end. The flexible material is preferably a fabric such as, for example, nylon. The fastener is closed by pressing the hook members against the fabric.

The sixth embodiment is a modification of the second version of the second embodiment where the components of the receptacle member form a truncated, conical end portion in outline. These components include a raised central section with a divider member that segregates the raised central section into a plurality of inner compartments, each inner compartment sized to hold only one golf club. The receptacle member has a perimeter section that is spaced from, and connected to, the raised central section by a plurality of partition members to form between the perimeter section and the raised central section a plurality outer compartments. These outer compartments are sized to hold one or more golf clubs. The divider member may have a cross-shaped configuration including four arms that extend outward from the common center point. Preferably, there are four partition members, each individual partition member being aligned with one of the arms of the divider member, and the individual partition members are tapered. Preferably, the raised central section has a flat top. The perimeter section a sufficient distance so that the heads of the golf clubs in the perimeter section do not strike the heads of the golf clubs in the raised central section. Preferably, the raised central section is above the perimeter section a distance of from 1 to 4 inches.

The seventh embodiment includes a receptacle structure having (a) an internal end portion which is received within the cavity of the bag body, said internal end portion having a generally flat surface section including a plurality of opening therein sized to hold only one golf club, and (b) raised end portion along an edge of the flat surface section having a generally flat surface section including a plurality of opening therein sized to hold only one golf club. Preferably, the raised end portion has a generally C-shaped configuration. The flat surface section of the internal end portion is about flush with the open mouth of the cavity, and the raised end portion extends outward from the cavity above the open mouth of the cavity. The flat surface sections of the internal end portion and the raised end portion are substantially parallel. Preferably, the receptacle structure has a generally circular configuration. The raised end portion is above the internal end portion a sufficient distance so that the heads of the golf clubs in the internal end portion do not strike the heads of the golf clubs in the raised end portion. Preferably, the raised end portion is above the internal end portion a distance of from 1 to 4 inches.

In both the sixth and seventh embodiment, the receptacle structure is made from a foam material, and preferably covered with a protective skin.

DESCRIPTION OF THE DRAWING

The preferred embodiments of this invention, illustrating all its features, will now be discussed in detail. These embodiments depict the novel and non-obvious golf bag of this invention shown in the accompanying drawing, which is for illustrative purposes only. This drawing includes the following figures (Figs.), with like numerals indicating like parts:

FIG. 8 is a perspective view showing of a second version of the receptacle structure of second embodiment of this invention.

FIG. 9A is a perspective view showing of a third embodiment of the golf bag of this invention.

FIG. 9B is a plan view taken along line 9B—9B of FIG. 9A.

FIG. 9C is a cross sectional view taken along line 9C—9C of FIG. 9B.

FIG. 10D is a perspective view of the foam insert removed from its pocket and showing a hinge structure for the cover of the beverage containing section of the foam insert.

FIG. 15 is side view showing the foam insert normally contained in the pockets shown in FIG. 10 removed and attached to a waist pouch worn by a golfer.

FIG. 16 is rear view showing the foam insert attached to a waist pouch worn by a golfer.

DESCRIPTION OF THE PREFERRED EMBODIMENTS

First Embodiment

Figure 1:
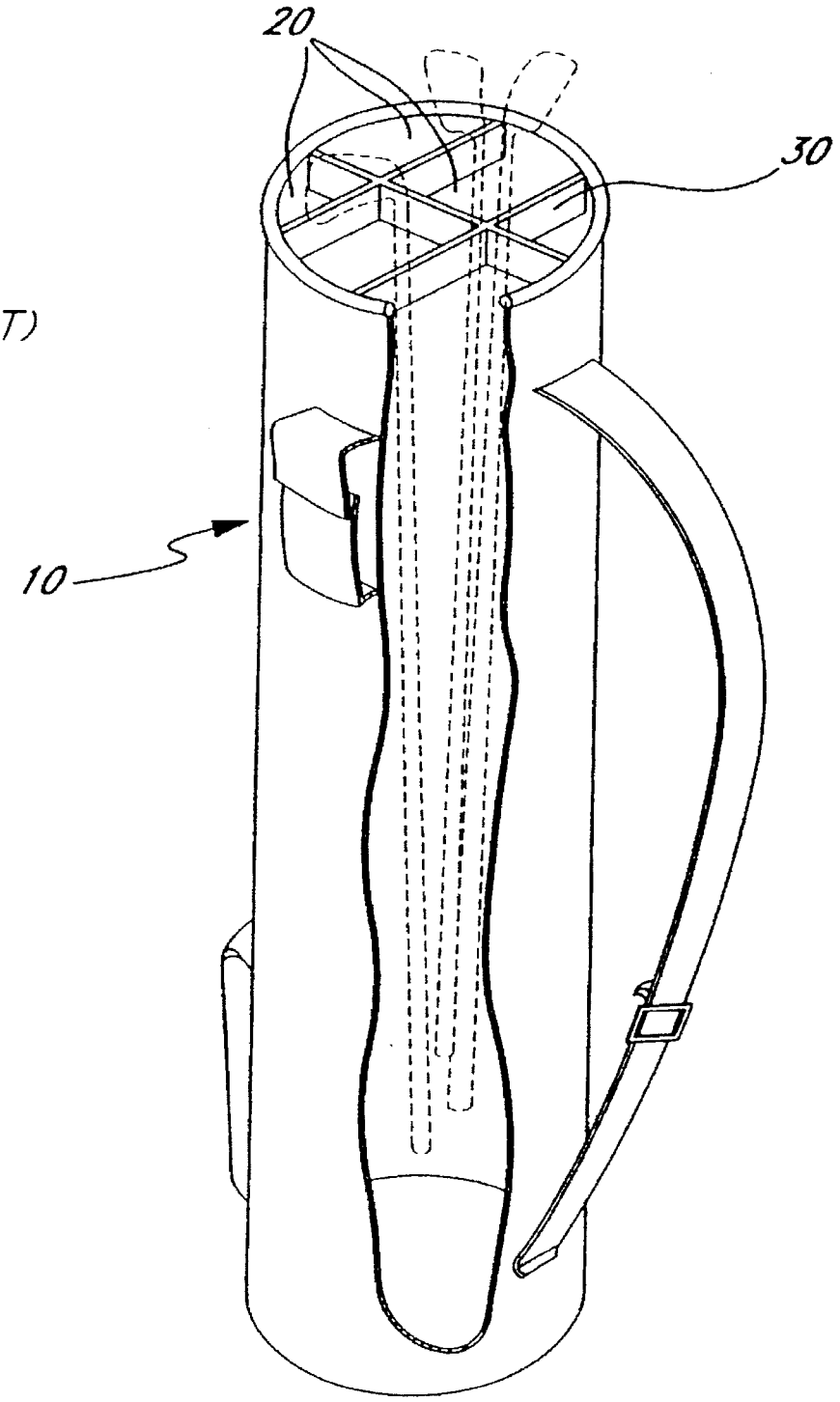
FIG. 1 (PRIOR ART)
FIG. 1 is a schematically perspective view illustrating the configuration of a conventional golf bag.
Figure 2:
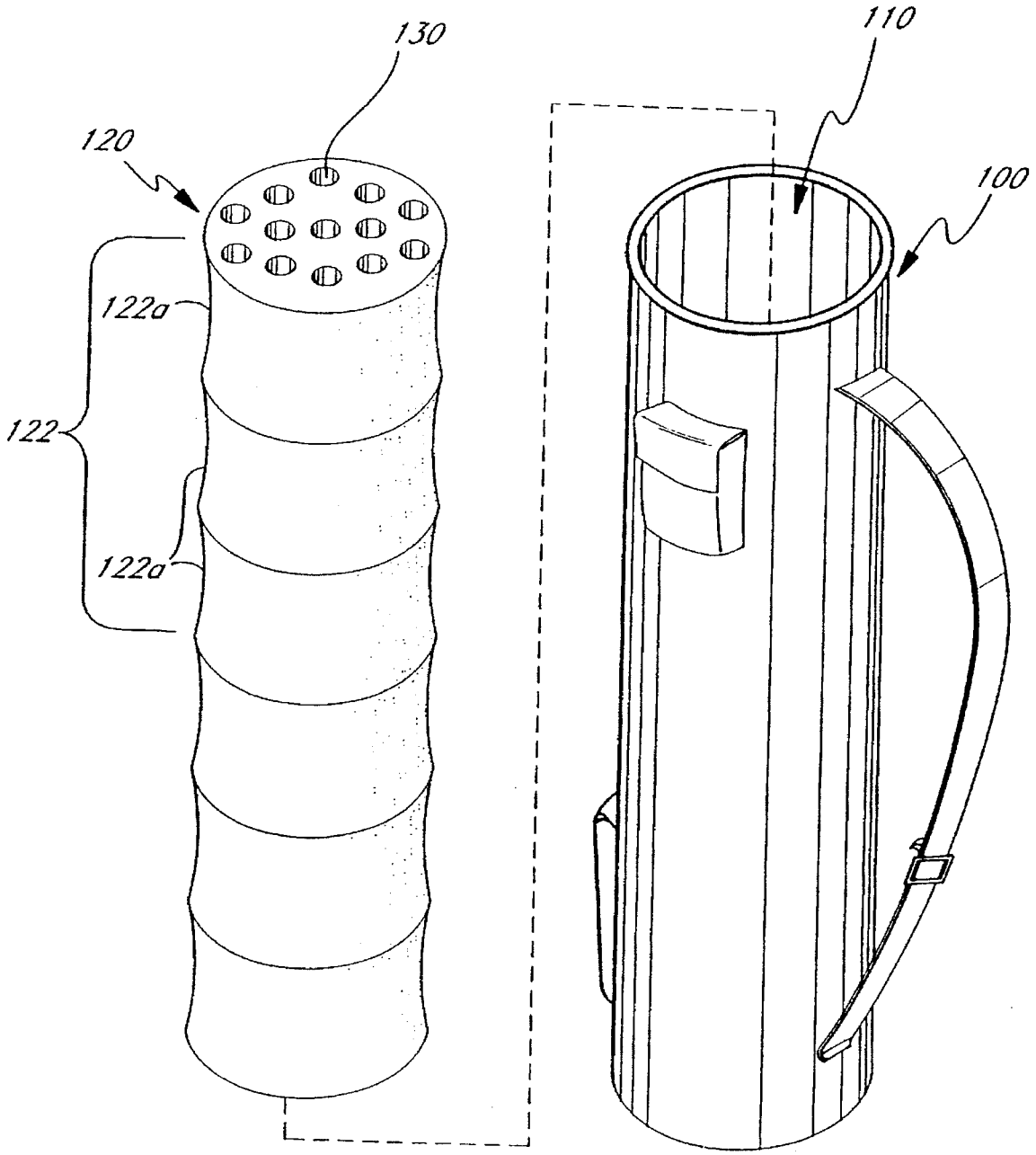
FIG. 2 is an exploded perspective view illustrating the configuration of the first embodiment of a foam organizer bag according to the present invention.

Referring to FIG. 2, a foam organizer bag 100 is illustrated in an exploded perspective view. The foam organizer bag 100 includes a normal golf bag having a cavity 110 to receive a plurality of golf clubs and a receptacle member 120 fitted into the cavity 110. The receptacle member 120 is provided with a plurality of holes or channels 130 formed in a longitudinal or lengthwise direction to store a number of golf clubs, respectively in each channel 130. The receptacle member 110 is made of hard sponge material in the form of the circular pole to absorb the impacts caused by the vibration of a golf club.

Also, the receptacle member. 110 includes a plurality of unit members 122 which are attached in a stacked configuration to one another by means of a suitable adhesive. The unit member 122 is provided with a concave portion **122*a* formed around the middle portion of its circumference that is fitted snug into the cavity 110. The receptacle member 110 is designed to minimize the shaking of the member within the cavity 110**.

Figure 3:
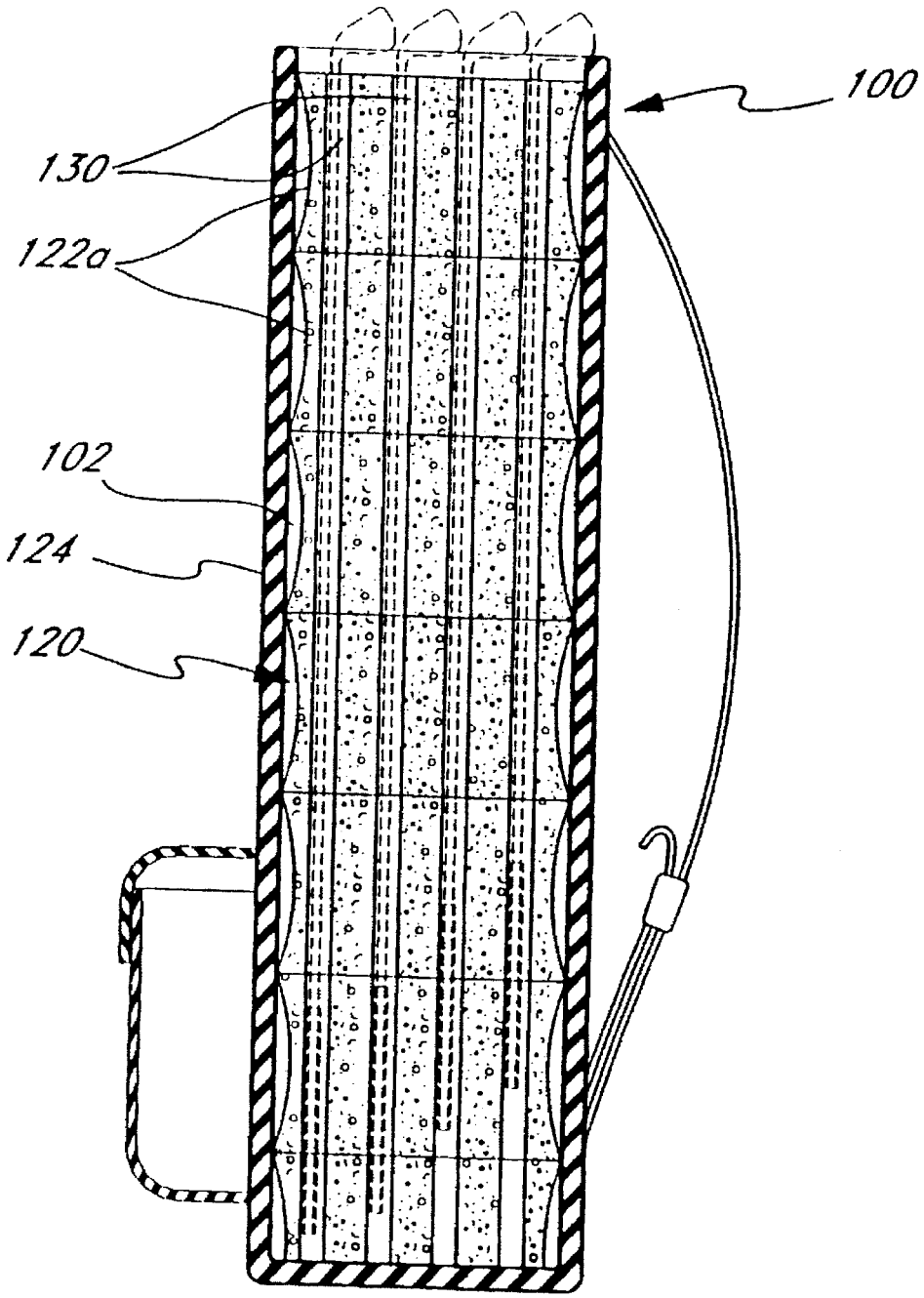
FIG. 3 is a cross-sectional view illustrating the installation of a receptacle member in a foam organizer bag according to the present invention.

Concretely, the receptacle member 120 includes a plurality of through-holes 130 formed from the upper portion to the lower portion, into each of which only one corresponding golf club is inserted. When the receptacle member 120 is fitted into the cavity 110, as shown in FIG. 3, a plurality of mountain portions 124 formed on contact with the unit members 122 to one another are pressed against the inner wall of the bag 100. At that time the concave portion **122*a* compensates for the pressing state to receive the receptacle member 120 into the cavity 110, flexibly, thereby removing or reducing the shaking of the receptacle member 120 itself. Therefore, a plurality of golf clubs are respectively stored into each of holes 130** to prevent their damage and the noises caused due to the clashes therebetween.

Figure 4:
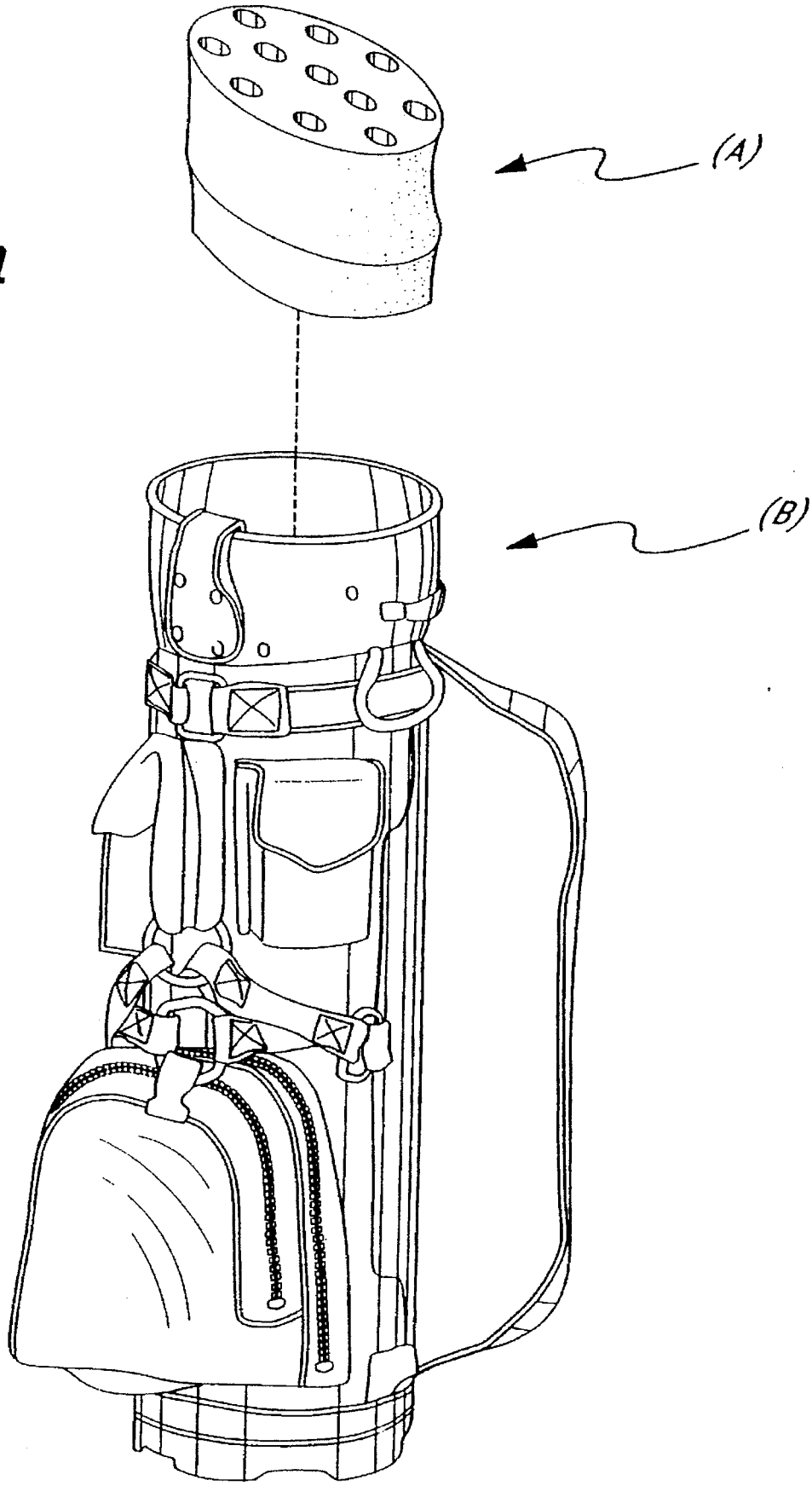
FIG. 4 is an exploded perspective view illustrating another version of a receptacle member for inserting into a normal golf bag according to the present invention.

Furthermore, as shown in FIG. 4, the receptacle member 120 may be made in the form of a foam insert, corresponding in configuration to the configuration of the cavity of a golf bag to be used, and having a height of ⅓ of the height of the golf bag to be used. This member 120 fits snug with the cavity 110 so that it does not tend to move from its position near the open top of the cavity.

Accordingly, the present invention relates to a foam organizer bag, providing a golf club receptacle structure which has a plurality of holes or channels 130 for storing a number of golf clubs in individual channels, but separated from one another, thereby preventing clashing of the clubs to suppress noise and protect the golf clubs against damage.

Second Embodiment

The second embodiment of this invention has two versions 10 and 12. The first version 10 is shown in FIGS. S through 7B, and FIGS. 12 and 13, and the second version 12 is shown in FIG. 8. Both versions 10 and 12 employ a receptacle structures **10*a* and 12*a*, respectively, with an elevated central section 14 for holding woods which is surrounded, at least partially, by a marginal section 16** holding irons.

In the first version 10, the receptacle structure **10*a* sits snug within the open mouth 11 of the golf bag 13. An internal portion 15 of the receptacle structure 10*a* is contained substantially within a cavity 17 that holds the golf clubs and a truncated conical portion 18 extends outward from the open mouth 11. The internal portion 15 of the receptacle structure 10*a* is wedged tightly into the open mouth 11 and does not move. There are elongated openings 20 extending lengthwise through the receptacle structure 10*a*, and a number of these openings 20*a*–20*d*, for example four, extend only through the generally flat top 22 of the truncated conical portion 18 of receptacle structure. The other openings 20 extend both through the top 22, intersecting the edge of the top and a sloping side wall 24 which extends between the top and a base 26 which is adjacent the edge of the open mouth 11** of the golf bag.

Figure 12B:
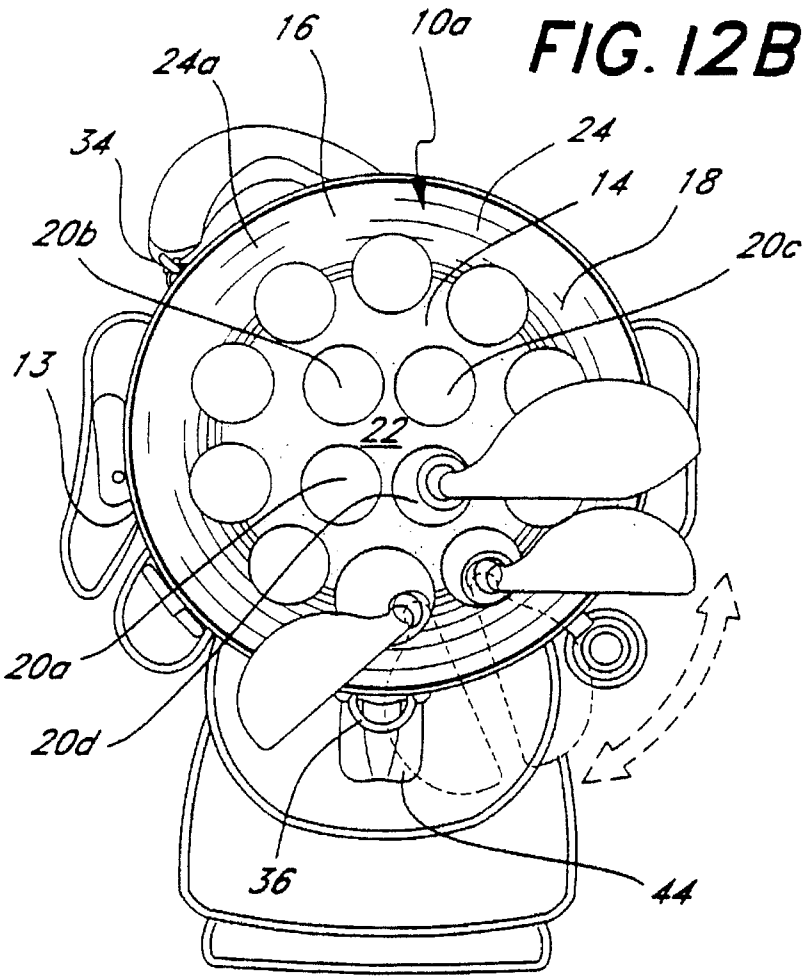
FIG. 12B is a cross-sectional view taken along line 12B—12B of FIG. 12A.
Figure 12A:
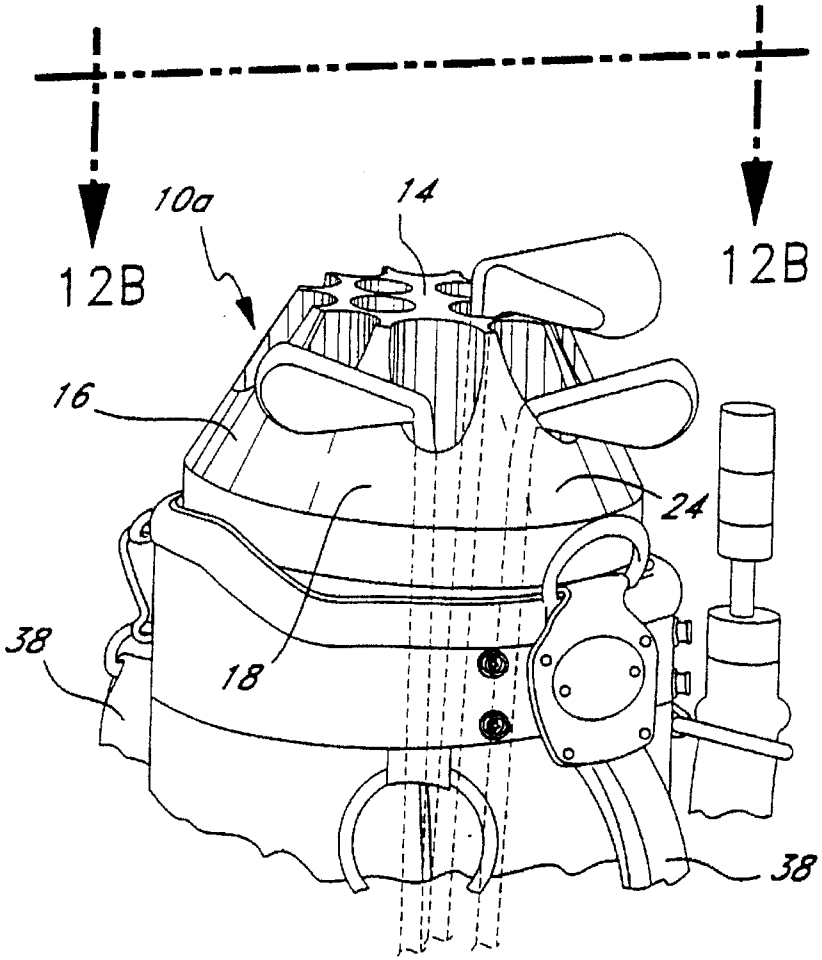
FIG. 12A is a fragmentary perspective view of the upper portion of the golf bag shown in FIG. 5.
Figure 13:
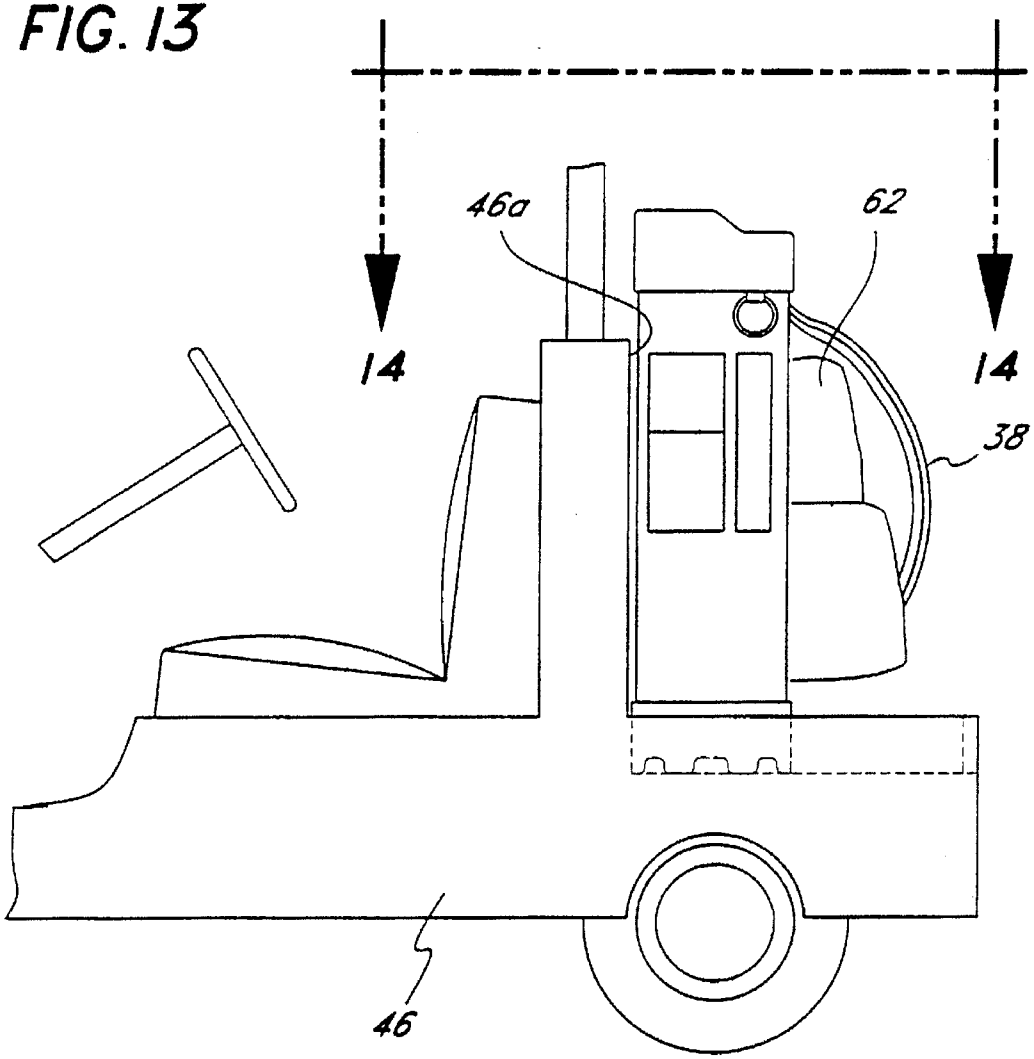
FIG. 13 is a side elevational view showing the golf bag of FIG 9A attached to a golf cart.

The openings 20 are only large enough to accept a single golf club. The woods, which have longer shafts than the irons, are placed in the four openings 20*a*–20*d* in the top 22 and the irons are placed in the openings 20 which are in the sloping side wall 24. As best shown in FIGS. 12 and 13, the openings 20 in the sloping side wall 24 provide an entryway with an elliptical border 24*a*. This elliptical border 24*a*, or edge, serves to limit the distance the iron heads can turn to and fro while they are in the receptacle 10*a*. The head of the iron will strike the elliptical border 24*a* before it engages an iron disposed in an adjacent opening 20. Consequently, the irons do not clash into each other when the golf bag is being carried.

As illustrated in FIG. 8., in the second version 12 there is an elevated central section 14 in the receptacle structure 12*a* which includes four openings 20*a*–20*d* which extend in a lengthwise direction through the receptacle structure. Again, each opening 20 is sized to receive only one golf club. The central section 14 is elevated above the marginal section 16 a sufficient distance so the clubs received in the openings 20 in the marginal section, do not strike clubs in the openings 20*a*–20*d* in the central section. Preferably, the central section is concentric with the marginal section and is about 2.0 to 5 inches above the marginal sectional. The diameter of the top 22 of the central section 14 ranges between about 3 and about 6 inches, and the marginal section has a depth which ranges between about 1 and about 4 inches.

Figure 7A:
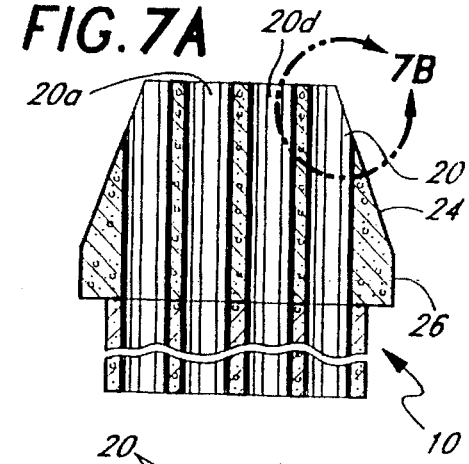
FIG. 7A is a cross sectional view taken along line 7A—7A of FIG. 6.
Figure 7B:
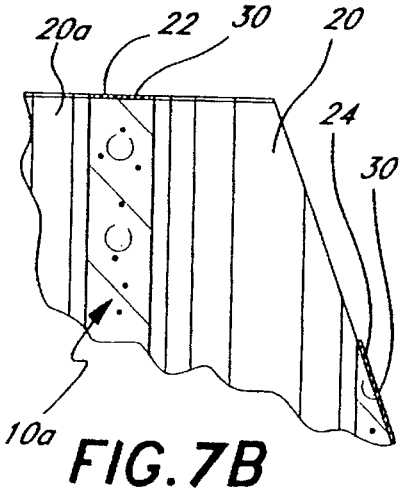
FIG. 7B is an enlarged fragmentary portion taken along the line 7B of FIG. 7A—7A.

The receptacle structures 10*a* and 12*a* of both versions 10 and 12 are preferably made of a foam material as discussed above which has closed cells to prevent the absorption of water. The density of the foam material is less than 12 pounds per cubic foot. As best depicted in FIG. 7B, preferably, there is a thin skin 30 less than ¼ inch of material covering the receptacle's external surface which is tough and prevents damage of the underlying foam. This skin 30 is formed by during molding of the receptacle structure 10*a* or 12*a* using a conventional process where a polyurethane material with a foaming agent is injected into a heated mold. The heat causes the foaming agent to produces a gas with forms the cells of the foam material. When the material contacts the walls of the mold the thin, substantially non-porous skin 30 is formed.

Figure 5:
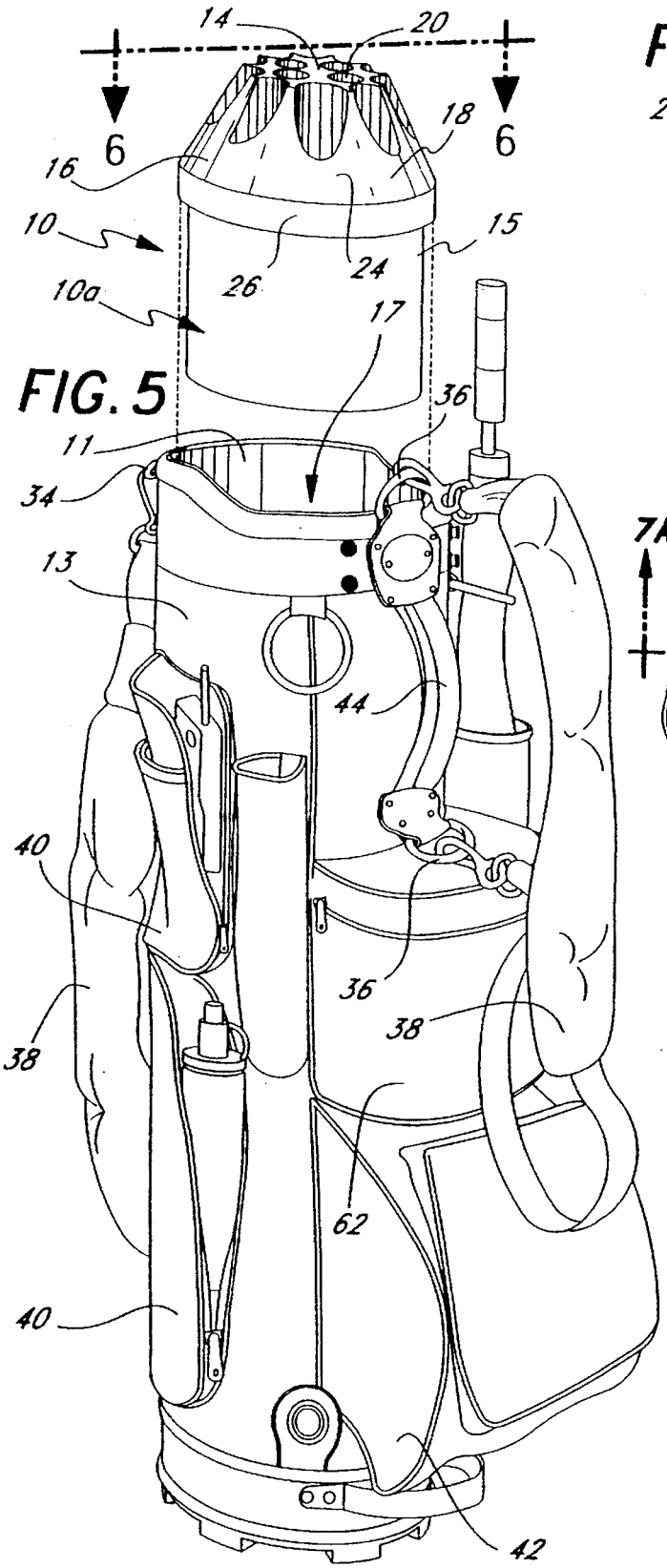
FIG. 5 is a perspective view of the first version of a second embodiment of this invention employing a golf club receptacle structure which has an outwardly extending truncated conical in portion.
Figure 6:
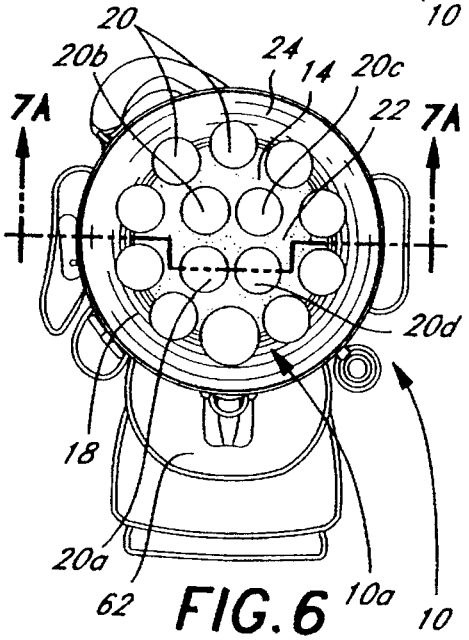
FIG. 6 is a plan view taken along line 6—6 of FIG. 5.
Figure 14:
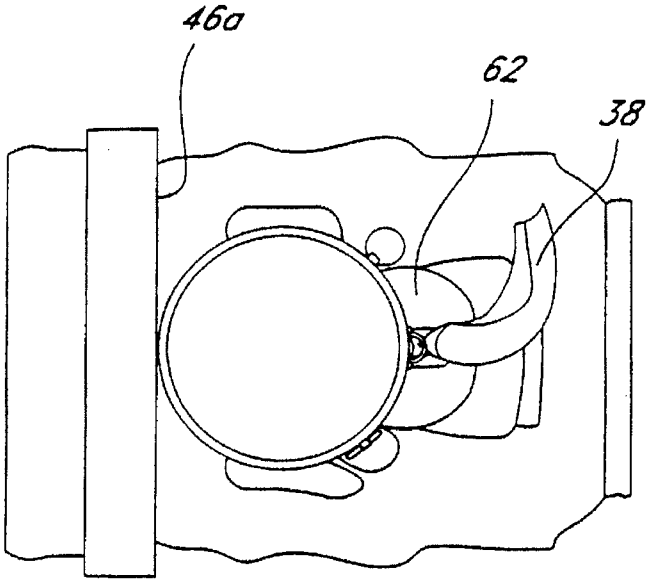
FIG. 14 is a plan view taken along line 14—14 of FIG. 13.

The golf bag also has such features as pairs of loops 34 and 36 both on the front and back side which enable a strap 38 to be switched between the front and the back. As shown in FIG. 5, two straps are depicted, one on the front and another on the back of the golf bag. The bag also includes a number of pockets 40 for holding such items as radio telephones, a water bottle, and enlarged pockets 42 on one side. These enlarged pockets 42 are only on the one side, preferably below a handle 44. Thus, by removing the strap 38 on the front side, the bag may be placed on a golf cart 46 as shown in FIGS. 13 and 14 with the back side flushed against the rear wall 46*a* of the cart as depicted in FIG. 14.

Third Embodiment

The third embodiment of the golf bag of this invention is depicted in FIGS. 9A through 9C. In this embodiment, a relatively thin or shallow receptacle structure 50 is employed which is fitted snugly into the open mouth 11 of the golf bag. The overall height of this receptacle ranges between about 1 and 6 inches. It has a somewhat triangular configuration as best illustrated in FIG. 9B. This conforms to the overall shape of the open mouth 11 of the bag, which thereby provides a relatively flat back side for placing the golf bag on a golf cart 46 as shown in FIG. 13 after removing the strap 38.

The receptacle structure 50 has three sections: a first section 52 at a lower level, a second section 56 at an elevated level above the first section, and a third, intermediate section 54 connecting the first and second sections. Each section 52, 54 and 56 includes a partition wall 58 that divides the section into approximately two equal size opening 60*a* and 60*b* which receive one or more golf clubs. The petition walls 58 of each section are aligned. Preferably, this receptacle structure 50 is made from foam as discussed above and has a protective skin 30 covering it in a manner similar to that discussed with the embodiment depicted in FIG.7B.

The elevated section 56 is best suited to hold woods, and it is adjacent the back of the golf bag so that the woods will be next to the seat wall 46*a* when the bag is placed on a golf cart 46 as shown in FIGS. 13 and 14. The lower irons (9 iron, 8 iron, 7 iron and wedge) are preferably placed in the lower section 52, and the long and intermediate irons (2 iron through 6 iron) are placed in the intermediate section 54.

Fourth Embodiment

Figures 10, 10A, 10B, 10C, 11A, 11B:
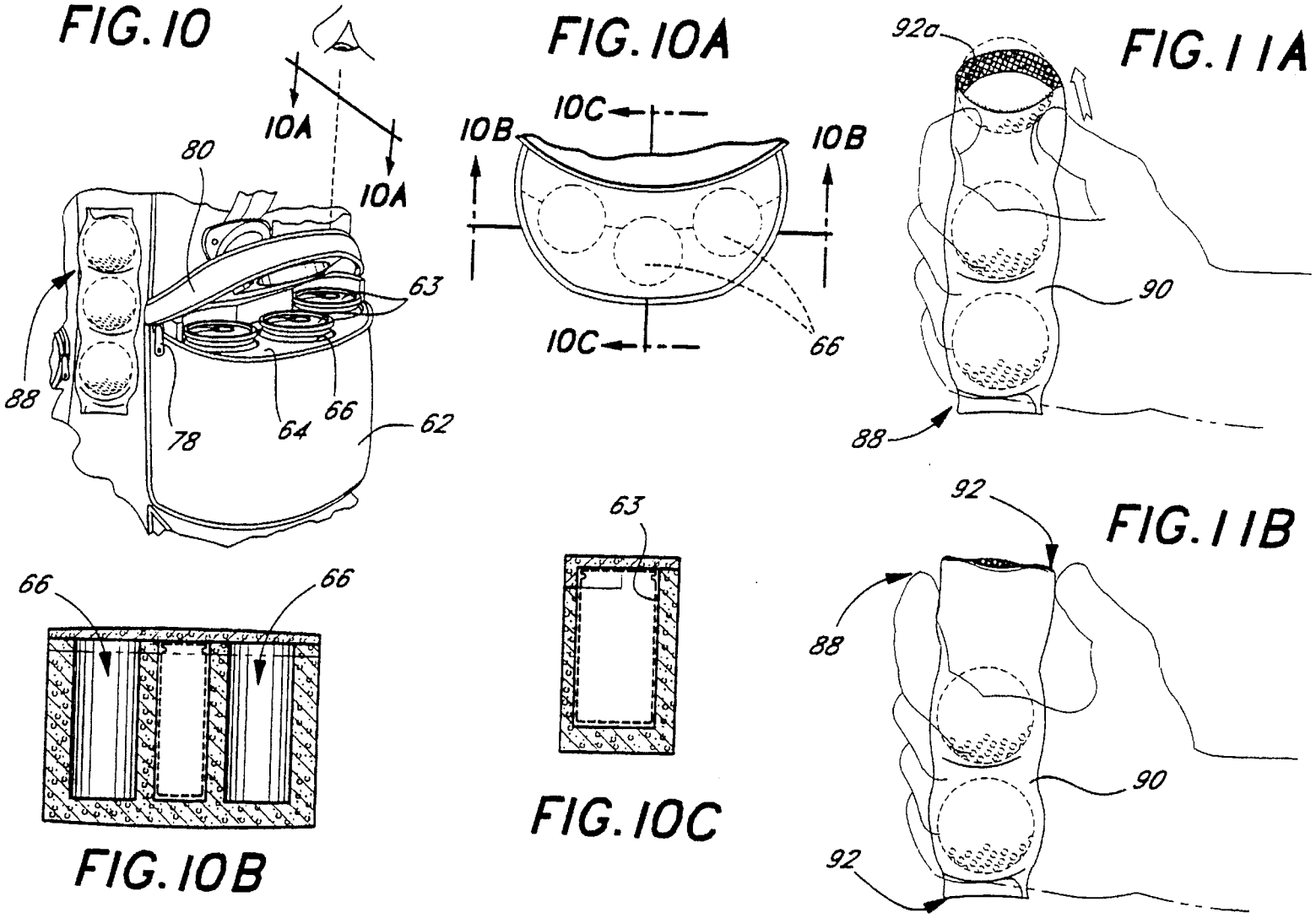
FIG. 10 is a perspective view of the fourth embodiment of the golf bag of this invention illustrating a pocket used to hold beverage cans.
FIG. 10A is a plan view taken along line 10A—10A of of FIG. 10.
FIG. 10B is a cross sectional view taken along line 10B—10B of FIG.10A.
FIG. 10C is a cross sectional view taken along line 10C—10C of 10A.
FIG. 11A is an enlarged fragmentary view of golf ball holding device shown in FIG. 9A.
FIG. 11B shows closing the golf ball holding device shown in FIG. 11A.

FIGS. 10 through 10D depicts a unique pocket 62 designed to hold beverage cans 63 and keep them at a desired temperature. This pocket 62 holds a foam insert 64 which has at least one cylindrical cavity 66 conforming to the configuration of the beverage can. Typically, the cans 63 will be cold and the foam insert 64 prevents the cans from warming rapidly. Typically, three cavities 66 are provided in a row side by side. The inside wall 68 of the foam insert 64 has a an arcuate surface whose purpose will discussed in greater detail subsequently. There is a foam cover 70 which sits on the insert 64. This foam cover 70 also includes a series of cylindrical cavities 72 of equal diameter and substantially shallower depth than the cavities 66 in the foam insert 64. These shallow cavities 72 are aligned with the deep cavities 66 in the foam insert. The cover 70 is hinged by pegs 74 which extend outward from the inside surface of the cover and are plugged into orifices 76 in the foam insert 64 as depicted in FIG. 10D. The shallow cavities 72 receive top portions of the cans 63 when the cover is closed. Preferably, there is a zipper 78 with one portion along an edge of a flap 80 overlying the foam insert 64 and another portion along the edge of the base of the pocket 62 to enable the golfer to seal or close the pocket after the beverage cans 63 are placed in the cavities 66. In accordance with a unique aspect of this foam insert 64, it is removable and can be placed, for example, in a waste pouch 82 which is worn by the golfer as depicted in FIGS. 15 and 16. The internal arcuate surface 68 is ideally suited t6 ,rest on the upper buttocks or side of the golfer when the loath insert 64 and cover 70 are placed in the waist pouch 82.

Fifth Embodiment in accordance with another unique feature of this invention, there is shown in FIGS. 10, 11A and 11B a golf ball holding device 88 attached to the side of the golf bag. This golf ball holding device 88 comprises a tubular structure 90 made out of a flexible material, preferably a fabric such as, for example nylon. At one or both ends of this tubular structure 90 is a hook and fabric type fastener 92 such manufacture by VELCRO Corporation. The tubular structure 90 has a diameter approximately equal to the diameter of a golf ball and has a length suitable for holding several golf bails, for example, three. The golf bails are lined up in a row one adjacent each other, and one end is closed with the hooks 92*a* of the hook and fabric fastener grabbing the fabric of the tubular structure 90, locking the tubular structure closed so that the golf bails remain in place. To remove a golf ball, the golfer simply squeezes the tubular structure 90, forcing the golf ball to open the fastener 92 and pop out of the tubular structure. The golfer then simply presses the open end together so that the hooks engage the fabric and close the tubular structure 90, keeping the remaining golf bails within the tubular structure.

Sixth Embodiment

Figure 18B:
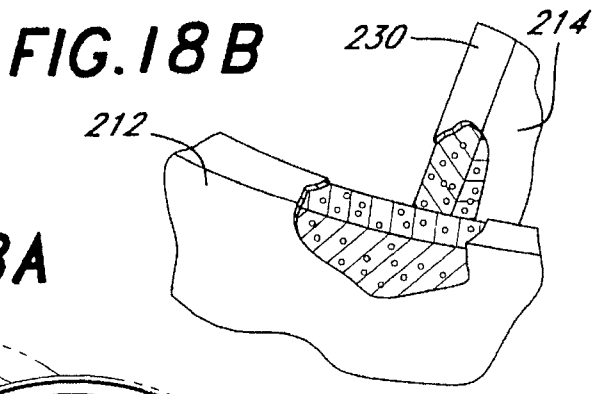
FIG. 18B is a fragmentary view taken along line 18B of FIG. 17.
Figure 18A:
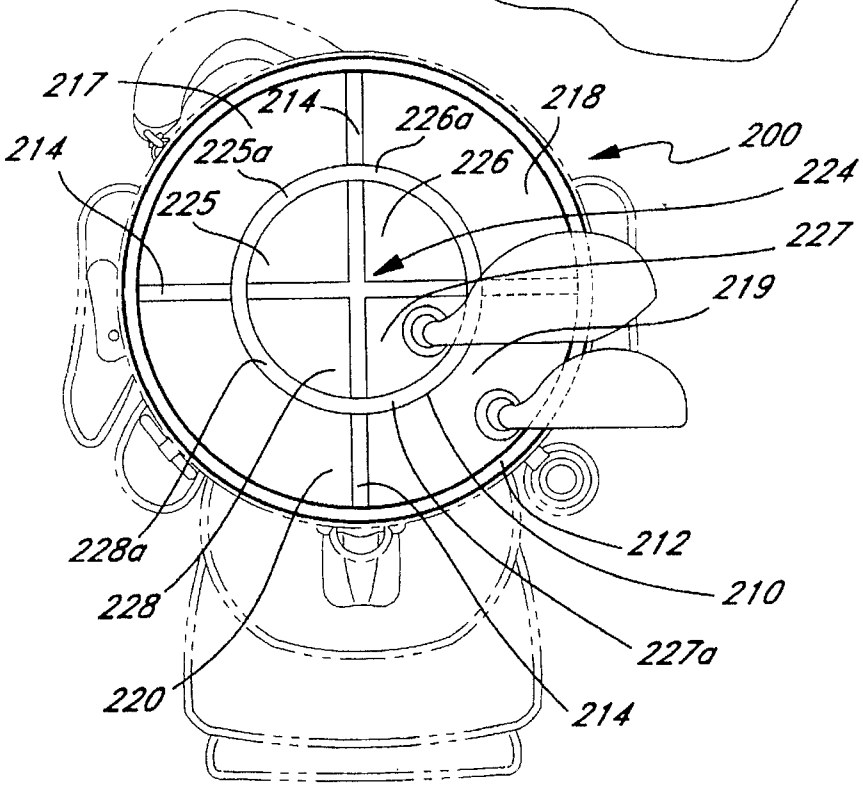
FIG. 18A is a plan view taken along line 18A—18A.
Figure 17:
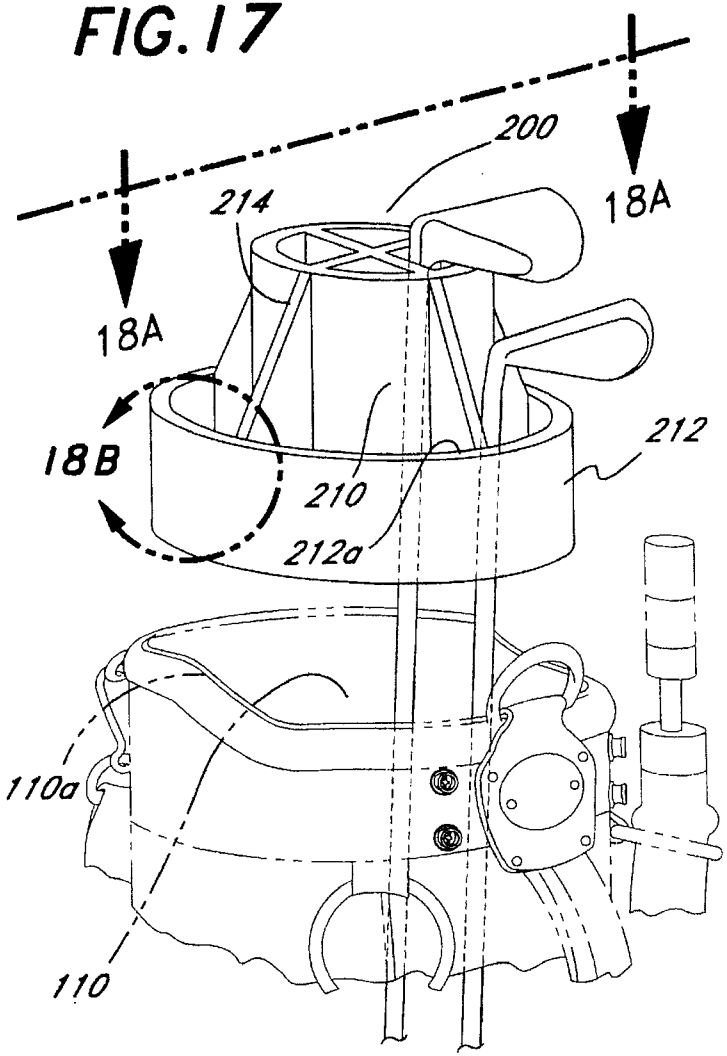
FIG. 17 is an exploded perspective view of the sixth embodiment of the golf bag of this invention.

As shown in FIGS. 17 through 18B, the sixth embodiment of this invention includes a receptacle member 200 which has, in outline form, a generally truncated conical configuration. This receptacle member 200 has a raised central section 210 and a perimeter section 2 12 connected together by four radially spaced partition walls 214. The perimeter section 2 12 is at the lower end portion of the receptacle member 200 and it fits into the open mouth of the cavity 110 of the body of the golf bag. Both the mouth and the perimeter have a circular configuration of approximately the same diameter and the lower end portion of the receptacle member 200 fits into the open mouth and is substantially covered by the bag body.

The partition walls 214 are tapered along the outside edge and are spaced apart to provide four outer compartments 217–220. Each of these four compartments is adapted to receive one or more golf clubs. The compartments 217–220 depicted are designed to hold a plurality of golf clubs, but the number of partition walls 214 could be increased so that there would be a single compartment for only one golf club. The raised central section 210 is elevated approximately one to four inches above the perimeter section. It has a hollow interior and is circular in configuration. A cross-shaped divider 224 divides the raised central section into four inner compartments 225–228, each compartment being designed to hold only one golf club.

In accordance with this invention, the entire receptacle member 200 is molded from a foam material, such as polyurethane, and covered with a tough skin 230 (FIG. 18B) that prevents damage to the internal foam structure. This unitary receptacle member 200 may be removed from the cavity 110, but preferably, it is force-fitted into the open mouth of the cavity so that it fits snug. The position of the receptacle member 200 within the cavity 110 is such that the edge 110*a* of the mouth is flush with the upper edge 212*a* of the perimeter section 212. The perimeter section 212 and the raised central section 210 have a common center point and, preferably, the four arms 225*a*, 226*a*, 227*a*, and 228*a* of the cross-shaped divider 224 are aligned with individual partition walls 214.

Seventh Embodiment

Figure 20B:
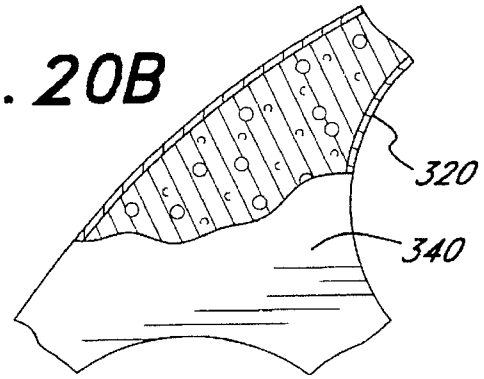
FIG. 20B is a fragmentary view taken along line 20B of FIG. 20A.
Figure 20A:
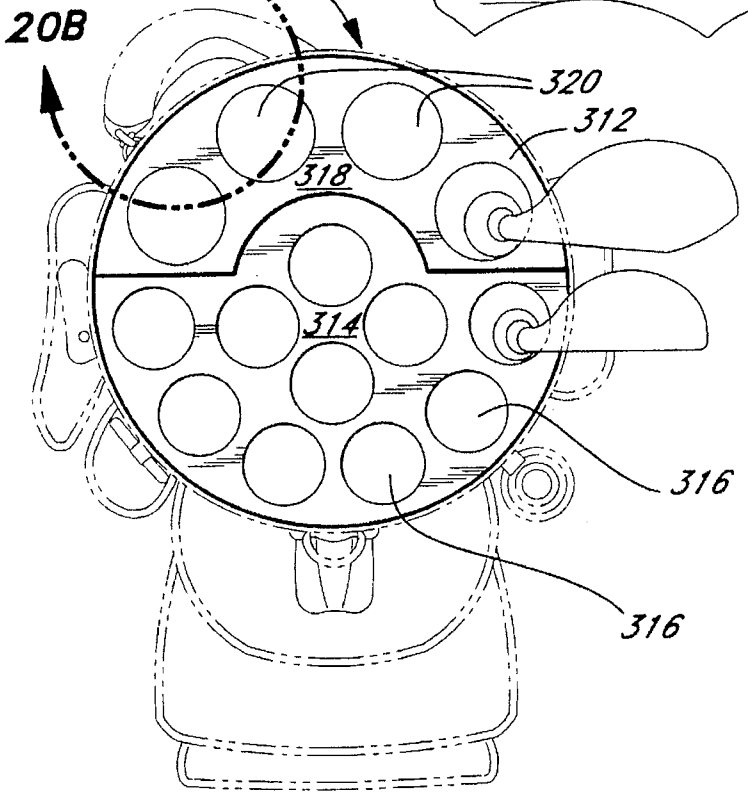
FIG. 20A is a plan view taken along line 20A–20A of FIG. 19.
Figure 19:
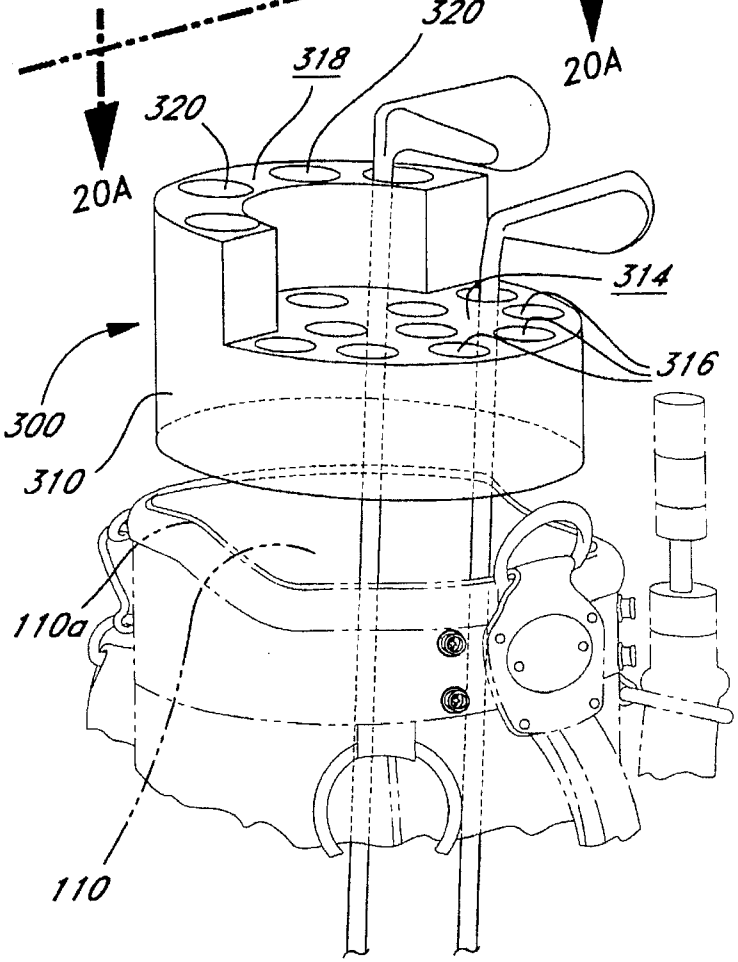
FIG. 19 is an exploded perspective view of the seventh embodiment of this invention.

As shown in FIG. 19 through 20*b*, the seventh embodiment of this invention comprises a receptacle member 300 which has a internal end portion 310 which is received within the cavity 110 of the golf bag and a raised end portion 312 along an edge of a flat surface 314 of the internal end portion. The raised end portion 312 projects upward from the surface 314 of the internal end portion 310. There are a plurality of openings 316 extending through the flat surface 314 of the internal end portion 310. Each of these openings 316 is sized to hold only one golf club. The raised end portion 312 has a flat surface 318 which includes a plurality of openings 320 extending through the flat surface 318 of the raised end portion. Each of these openings 320 is also sized to receive only one golf club.

Preferably, the receptacle member 300 has a generally cylindrical configuration which conforms to the open mouth of the cavity 110 in the bag body. This receptacle member 300 is forced into the open mouth to fit snug within it so that the flat surface 314 of the internal end portion 310 is about flush with the edge 110*a* of the open mouth of the cavity 110. The raised end portion 312 is elevated approximately one to four inches above the flat surface 314 so it is a sufficient distance above this flat surface so that the heads of the golf clubs in the opening 316 do not strike the heads of the golf clubs in the raised section 312. Preferably, the raised end portion has a generally C-shaped configuration.

In accordance with this invention, the entire receptacle member 300 is molded from a foam material, such as polyurethane, and covered with a tough skin 340 (FIG. 20B) that prevents damage to the internal foam structure.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

We claim:

1. A golf bag which hold golf clubs, including a cavity in which a golf club receptacle structure is disposed, said receptacle structure being made from a foam material and having (a) an internal end portion which is received within the cavity, (b) an external, and in outline, a substantially truncated, conical end portion at least partially extending outward from the cavity, and (c) a plurality of openings which extend in a lengthwise direction through said receptacle structure, said conical end portion having a raised central section with a divider member that segregates the raised central section into a plurality of inner compartments, each inner compartment sized to hold only one golf club.

2. The golf bag of claim 1 where the foam material is water proof, having closed cells.

3. The golf bag of claim 2 where the foam material has a density of no more than 12 pounds per cubic feet.

4. The golf bag of claim 3 where the foam material has an exterior which is covered, at least partially, by a thin, protective skin.

5. The golf bag of claim 1 where the receptacle structure has a configuration which substantially conforms to the configuration of the cavity.

6. The golf bag of claim 1 where the truncated, conical end portion has a perimeter section that is spaced from, and connected to, the raised central section by a plurality of partition members to form between the perimeter section and the raised central section a plurality outer compartments.

7. The golf bag of claim 6 where the outer compartments are sized to hold at least one golf club.

8. A golf bag which holds golf clubs, each club having a shaft and a head, said golf bag including a cavity in which a golf club receptacle structure is disposed, said receptacle structure being made from a foam material and having (a) a raised central section with a divider member that segregates the raised central section into a plurality of inner compartments, each inner compartment sized to hold only one golf club, and (b) a perimeter section that is spaced from, and connected to, the raised central section by a plurality of partition members to form between the perimeter section and the raised central section a plurality of outer compartments.

9. The golf bag of claim 8 where the raised central section has a circular configuration, and the perimeter section has a circular configuration, said raised central section and said perimeter section having a common center point.

10. The golf bag of claim 9 where the divider member has a cross-shaped configuration including four arms that extend outward from the common center point.

11. The golf bag of claim 10 where there are four partition members, each individual partition member being aligned with one of said arms of the divider member.

12. The golf bag of claim 11 where the individual partition members are tapered and the raised central section has a flat top so that the receptacle structure has, in outline, a substantially truncated conical configuration.

13. The golf bag of claim 8 where the raised central section is above the perimeter section a sufficient distance so that the heads of the golf clubs in the perimeter section do not strike the heads of the golf clubs in the raised central section.

14. The golf bag of claim 13 where the raised central section is above the perimeter section a distance of from 1 to 4 inches.

* * * * *